US006695665B2

(12) United States Patent
Devir

(10) Patent No.: US 6,695,665 B2
(45) Date of Patent: Feb. 24, 2004

(54) METHOD OF FORMING A DISCHARGE LAMP

(75) Inventor: Daniel D. Devir, South Sutton, NH (US)

(73) Assignee: Osram Sylvania Inc., Danvers, MA (US)

( * ) Notice: Subject to any disclaimer, the term of this patent is extended or adjusted under 35 U.S.C. 154(b) by 109 days.

(21) Appl. No.: 10/390,327

(22) Filed: Mar. 17, 2003

(65) Prior Publication Data

US 2003/0132697 A1 Jul. 17, 2003

Related U.S. Application Data

(62) Division of application No. 09/332,921, filed on Jun. 14, 1999.

(51) Int. Cl.[7] ..... H01J 9/26

(52) U.S. Cl. ..... 445/44; 445/26

(58) Field of Search ..... 445/43, 44, 26

(56) References Cited

U.S. PATENT DOCUMENTS 2,492,162 A * 12/1949 Litton ..... 445/44
2,692,298 A * 10/1954 Dailey ..... 445/43

* cited by examiner

*Primary Examiner*—Kenneth J. Ramsey
(74) *Attorney, Agent, or Firm*—William E. Meyer

(57) ABSTRACT

A sealing electrode for discharge lamp having electrically conductive cup, and an emitter pellet is disclosed. The cup seals a passage into the discharge lamp, and additionally supports the electrode pellet or tip for the discharge. The design enables the emitter, electrode and seal structure to be made separately off line, while also enabling the emitter to be protected from contaminants during subsequent assembly.

5 Claims, 6 Drawing Sheets

METHOD OF FORMING A DISCHARGE LAMP

This application is a divisional of U.S. application Ser. No. 09/332,921, filed Jun. 14, 1999.

TECHNICAL FIELD

The invention relates to electric lamps and particularly to electric discharge lamps. More particularly the invention is concerned with a sealing electrode for an electric discharge lamp.

BACKGROUND ART

Sealed beam headlamps used to be made with glass reflectors and lens. A filament, or a lamp capsule was enclosed in the interior, and electrically coupled to the exterior by two seals. Each seal was made with hole formed in the glass wall, and a little metal cup was pressed into the glass along the rim of the cup extending around the hole. A metal lead was then extended through the formed hole and attached to the bottom wall of the cup. An electrical connection could then be made to the exterior of the cup, thereby providing electric power through the metal cup to the enclosed filament.

DISCLOSURE OF THE INVENTION

A sealing electrode for a discharge lamp may be made with an electrically conductive cup having a circumferential wall having an interior surface defining an interior volume, and having a sealing portion formed on the cup, extending circumferentially around the cup. An emitter pellet is supported by the cup from at least a portion of the interior surface, the emitter pellet being electrically coupled to the cup. The cup is used to seal an entrance into the discharge lamp volume, while at the same time supporting the emitter acting as the discharge electrode.

BEST MODE FOR CARRYING OUT THE INVENTION

Figure 1:
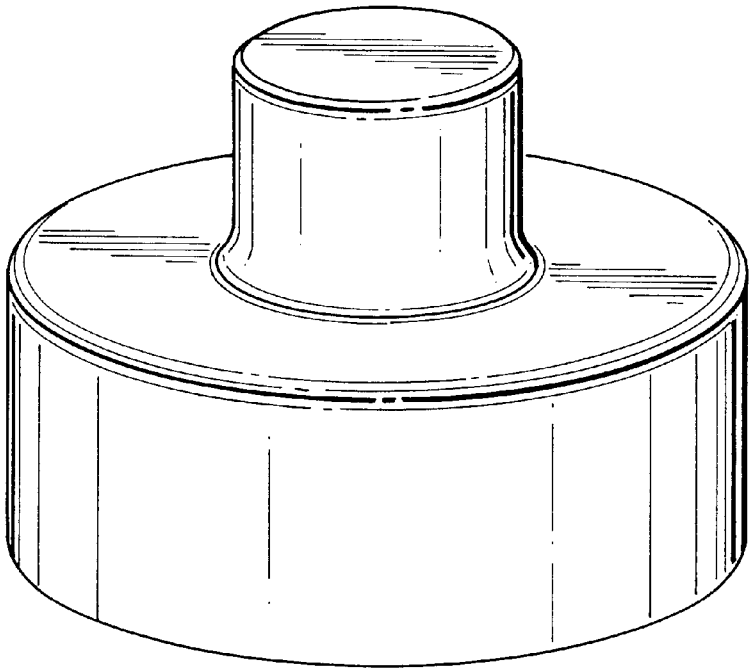
FIG. 1 shows a perspective view of a preferred embodiment of a sealing electrode for a discharge lamp.
Figure 2:
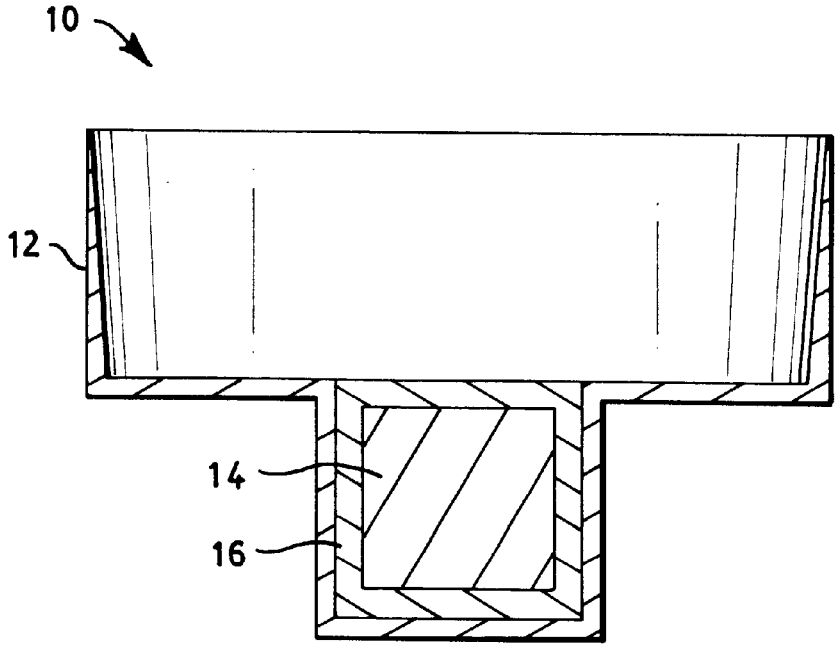
FIG. 2 shows a cross sectional view of a preferred embodiment of a sealing electrode for a discharge lamp.

FIG. 1 shows a perspective view of a preferred embodiment of a sealing electrode for a discharge lamp. FIG. 2 shows a cross sectional view of the preferred embodiment of a sealing electrode 10 for a discharge lamp. Like reference numbers designate like or corresponding parts throughout the drawings and specification. The sealing electrode for discharge lamp is assembled from an electrically conductive cup 12, and an emitter pellet 14. The pellet 14 may be enclosed by a cover or jacket 16.

Figure 3:
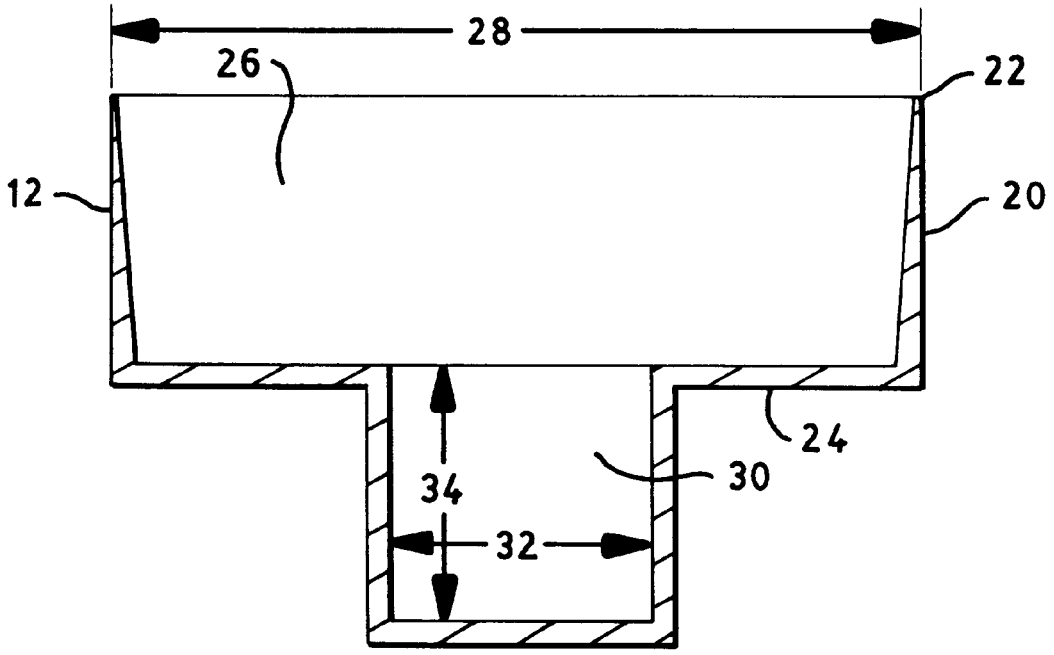
FIG. 3 shows a cross sectional view of an electrically conductive cup.

FIG. 3 shows an electrically conductive cup 12. The electrically conductive cup 12 may be made out of stamped or deep drawn metal sheet to have the general form of a cylindrical cup 12. The applicant suggests a nickel iron alloy, such as 42 alloy for use with a borosilicate glass. Alloy 52 may be used with a soft glass like SG 10, SG 80 or P360. The electrically conductive cup 12 has a circumferential wall 20 with a sealing edge 22, and a bottom wall 24, defining therewith a first cavity 26. The preferred sealing edge 22 is feathered. In the preferred embodiment, the circumferential wall 20 is cylindrical with a first inside diameter 28. In the preferred embodiment, the bottom wall 24 is further formed with a centrally located, depressed second cavity 30 in the form of a smaller cylinder having a second inside diameter 32 and an axial length 34.

Figure 4:
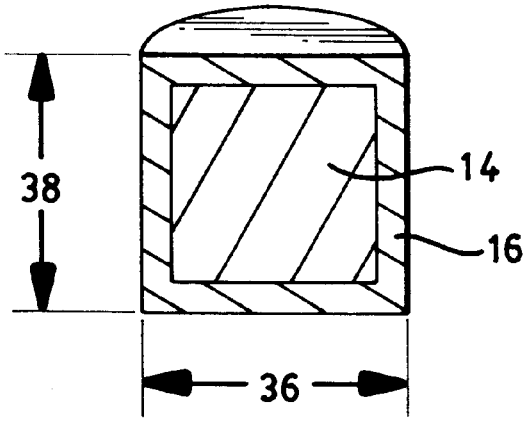
FIG. 4 shows a cross sectional view of an emitter pellet.

FIG. 4 shows an emitter pellet 14. The emitter pellet 14 may be made as a rigid body of emitter material, or of emitter and getter material to have the general form of a somewhat elongated cylinder with an outside diameter 36, and an axial length 38. A barium calcium tungstate (BCT) emitter, or variation thereof is suggested. The emitter getter may be formed from pressing a powered composition to form a solid body. The preferred outside diameter 36 is sufficiently small so that the pellet 14 may be conveniently positioned in the second cavity 30. The preferred axial length 38 is the same as the axial length 34 of the second cavity 30. The axial length 38 of the pellet 14 should not be so long as to interfere with the mounting of the cup with the lamp envelope 40. In the preferred embodiment emitter pellet 14 is encased in an outer jacket 16 that is electrically conductive. The Applicant suggest using copper or an iron based alloy such as 42 Alloy or 52 Alloy. The jacket 16 is to exclude air, moisture or other detrimental materials from merging with the pellet 14 material before the lamp manufacture is completed. The emitter (or emitter getter) material for example may be pressed in a metal can or a tube which may then be hermetically sealed. The outer diameter of the jacketed pellet 14 may conveniently chosen to be the same as the inner diameter 32 of the second cavity 30. The jacketed pellet 14 may then be tightly fitted into the second cavity 30, and thereby held in place. The electrically conductive cup 12 then holds the jacketed pellet 14 and is electrically coupled through the jacket 16 to the emitter pellet 14.

Figure 5:
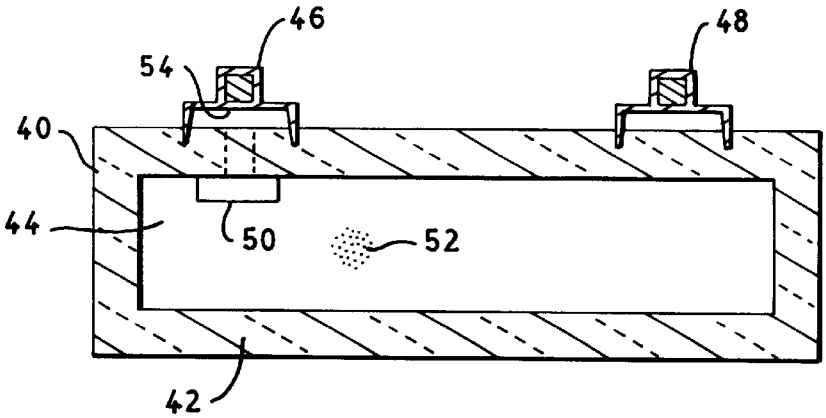
FIG. 5 shows a cross sectional view of a light transmissive lamp envelope.
Figure 6:
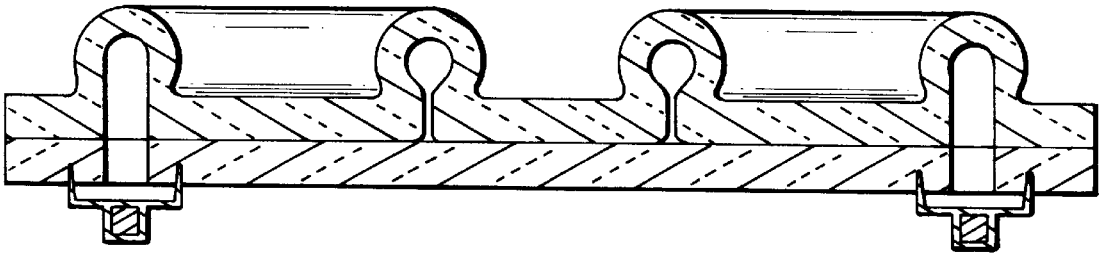
FIG. 6 shows a cross sectional view of a serpentine flat panel lamp.

FIG. 5 shows light transmissive envelope 40. The light transmissive envelope 40 may be made out of glass, hard glass or quartz to have the general form of a flat panel or an elongated tube having a wall 42 defining an enclosed volume 44 therein. In a flat panel embodiment, two parallel walls are narrowly separated defining the enclosed volume 44 therebetween. The enclosed volume 44 may be serpentine, spiraled, or otherwise conveniently patterned to define a useful discharge pattern. The sealing electrode 46 is sealed to the light transmissive envelope 40 along the sealing edge 22 by heating a selected portion of the lamp envelope 40 to a pliable state and then pressing the cup 12 along the sealing edge 22 into the pliable glass. To aid in sealing the sealing electrode 10 along the sealing edge 22, the sealing edge 22 may be pre-glassed . The preglassing the sealing edge 22 allows for a more complete wetting of the electrode 46 to the lamp envelope 40. In the preferred embodiment the cup 12 is sealed directly to the exterior of the envelope 40 in a region 50 initially having no through passage. The inner side of the envelope adjacent region 50 is chosen to be conveniently visible through another portion of the lamp envelope 40. As an example, FIG. 6 shows a cross sectional view of a serpentine flat panel lamp. A lower (or back) plate of glass is used to support the seal electrodes, while an upper (or forward) sheet of glass is formed with winding channel extending between two end openings. The glass pieces are mated so the two end openings are positioned adjacent where the seal electrodes are mounted.

The lamp envelope 40 is then flushed, filled with a selected lamp fill material 52 and sealed by methods known in the art. The fill material 50 may be made out of a rare gas, a rare gas combination, either of which may include dopants added thereto to be a gas, or vapor at the temperature of lamp operation. A laser is then focused through the lamp envelope 40 to impinge on the region 50 of the envelope 40 encompassed by the sealing edge 22. The region 50 is then eroded by the laser to form a through passage 54 leading to the sealing electrode 10. The jacket 16 encasing the emitter pellet 14 is then similarly eroded exposing the emitter pellet 14 to the enclosed volume 44. The small amount of envelope wall 40 and jacket 16 material that is sputtered into the enclosed volume 44 is not believed to significantly degrade the performance of the lamp. A similar second electrode 48 may be attached to the lamp envelope 40, and similarly opened to the enclosed volume 44 lamp interior to provide a second electrode 48 for the lamp discharge. The electrodes 46, 48 may now be electrically connected and a discharge started between the exposed emitter pellets and the fill material 50 of the enclosed volume 44. It is understood that a single sealed electrode could be used in forming a barrier discharge type lamp.

Figure 7:
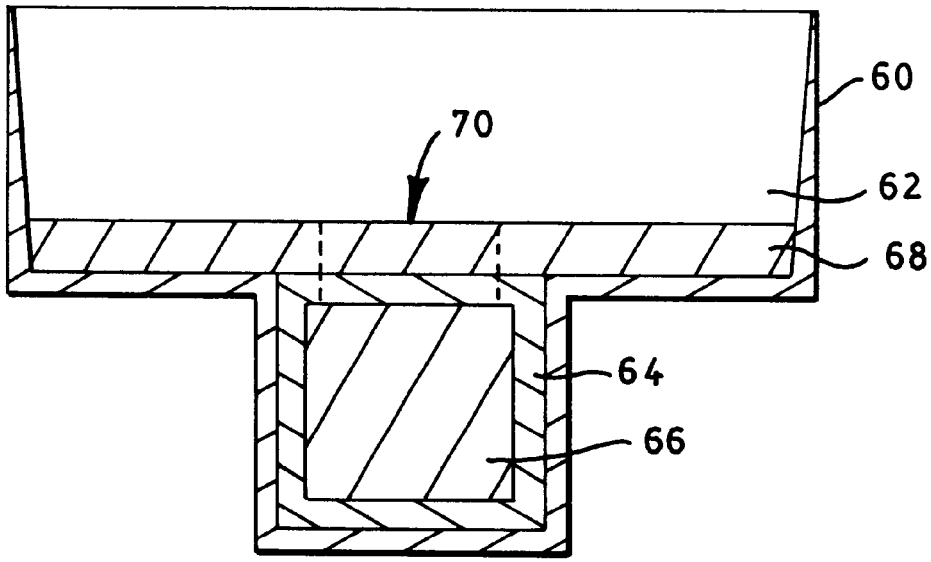
FIG. 7 shows a first alternative design of a sealing electrode.

FIG. 7 shows a first alternative design of a sealing electrode. The cup 60 is similarly formed with a first cavity 62 and a second cavity 64. The emitter pellet 66 is similarly formed, but is secured directly in the second cavity 64 without an intermediate jacket. The cup 60 and pellet 66 are then cleaned of objectionable materials, such as oxygen, air, water vapor and so forth. The pellet 66 is then covered by a glass or metal cover 68 that seals the pellet 66 in the second cavity 64. Once the sealing electrode is joined to the lamp envelope 40, a laser is again used to open a passage 70 through the glass or metal cover to reveal the emitter pellet 66.

Figure 8:
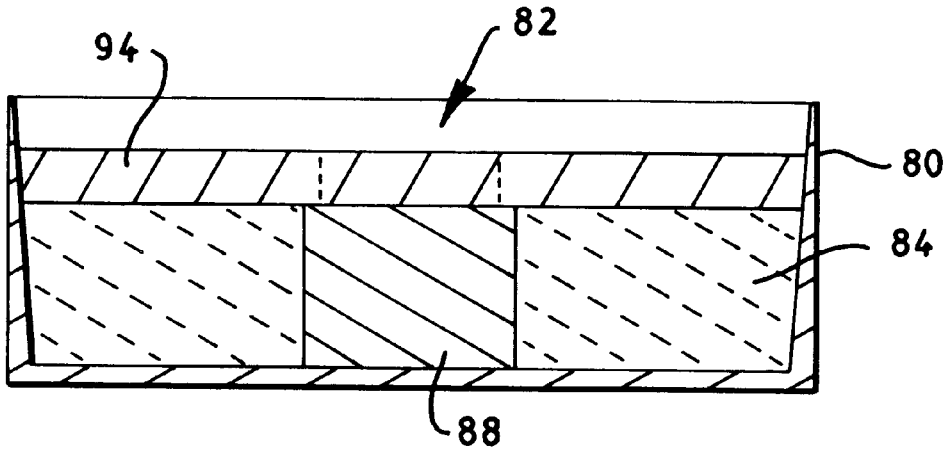
FIG. 8 shows a second alternative design of a sealing electrode.
Figure 9:
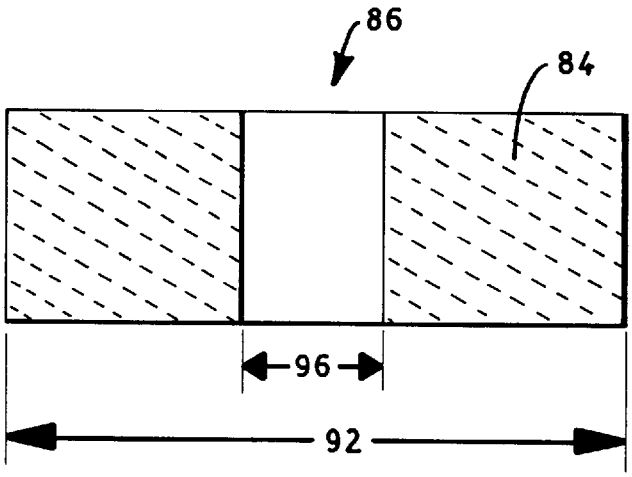
FIG. 9 shows a cross sectional view of a spacer.

FIG. 8 shows a second alternative design a sealing electrode. FIG. 9 shows a cross sectional view of a spacer. The cup 80 is formed with a first cavity 82. A spacer 84 with a central cavity 86 is securely positioned in the first cavity 82. FIG. 9 shows a spacer 84. The spacer 84 has a inside diameter 90, preferably sufficient to form a conformal fit with the outside of the pellet 88. The preferred spacer 84 has an outside diameter 92, preferably sufficient to form a conformal fit with the inside of the cup wall. The pellet 88 (or jacketed pellet) is positioned by the spacer 84 for location and support within the first cavity 82. It should be understood that spacer 84 here is meant to encompass such designs as a ring, two half rings, a split ring, a spiral, spool, or similar positioner for holding the pellet 88 in proper location within the first cavity 82. The spacer 84 may be made out of heat durable material such as glass or metal to have the general form of a thick walled cylinder having contact with the inner wall of the cup 80 and firmly positioning the pellet 88 in its proper location. The pellet 88 needs to be in electrical connected through the cup 80 to the exterior of the lamp. This may be achieved by using a metal spacer. Alternatively a non-conductive spacer, for example a glass or ceramic spacer, may be used if the bottom 90 of the pellet 88 (or jacketed pellet) is in contact with the bottom wall 92 of the cup 80. The electrically conductive cup 80 constrains the spacer 88 and therefore the pellet 88 (or jacketed pellet) within the region of the cylindrical wall. The inner diameter of the cup is then approximately equal to the outer diameter 92 of the spacer. The axial extent of the spacer 84 is less than the height of the cup wall. The emitter pellet 88 is held in position within the inner diameter 90 of the spacer. This may be accomplished by press fitting, crimping, welding or other convenient means. A cover 94 may enclose the spacer within the cup.

The spacer 84 can be made of either a metal or an insulating material. A metal spacer 84 would of itself provide electrical connection between the cup 80 and the emitter pellet 88. The cup 80, spacer 84 and pellet 88 are then cleaned of objectionable materials, such as oxygen, air, water vapor and so forth. The pellet 88 is then covered by a glass or metal cover 94 that seals the pellet 88, and the spacer 84 in the first cavity 82.

A cover 94 may them be placed over the emitter pellet 88, and the spacer 84 to seal with the cup 80 and thereby shield the emitter pellet 88 and the spacer 84 from the surrounding atmosphere. The cover 94 may be made out of laser meltable material such as glass or metal to have the general form of a disk. It is convenient that the cover 94 be conformal along one side with the pellet 88, (or jacketed pellet), and the adjacent regions of the cup. It is also preferred that little or not no free space exist between pellet 88, and cup 80 on one side and the cover 94 on another side. This is to limit the possible inclusion of offensive materials in these spaces. However, it is possible to process the pellet 88, cup 80 and cover 94 so that any free space would be filled with acceptable lamp file materials, such as the primary fill gas, or at least non-detrimental lamp fill materials.

The lamp sealing and electrode opening process thereafter proceeds the same as described above. Once the sealing electrode is joined to the lamp envelope 40, a laser is again used to open a passage to reveal the pellet 88. In this example, a portion of the passage 96 extends through the cover 94 plate.

Figure 10:
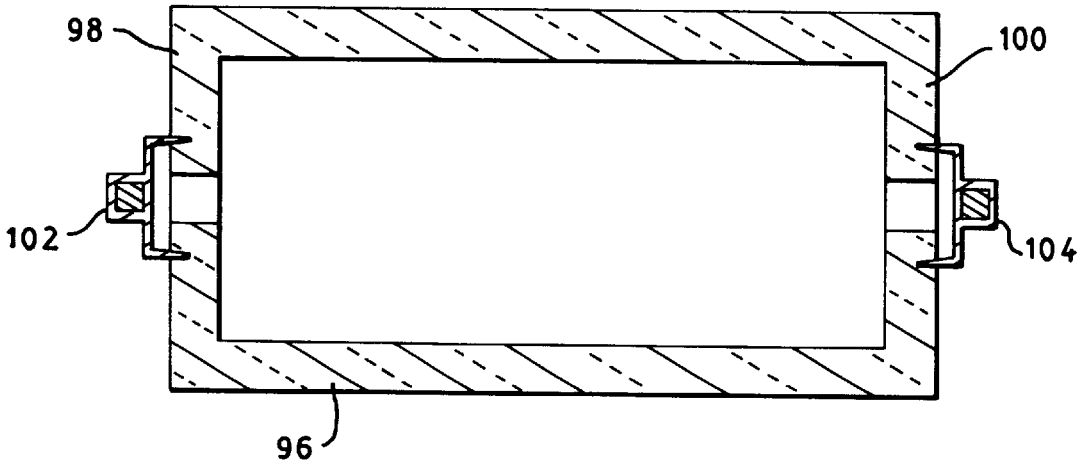
FIG. 10 shows a cross sectional view of a tubular lamp envelope with a preformed through passage.

FIG. 10 shows a cross sectional view of a tubular lamp envelope with a preformed through passage. The lamp envelope 96 is formed with end walls 98, 100 each having a through passage formed therein. The end walls 98, 98 are sufficiently thick to mate with and retain seal electrodes 102, 104.

Figure 11:
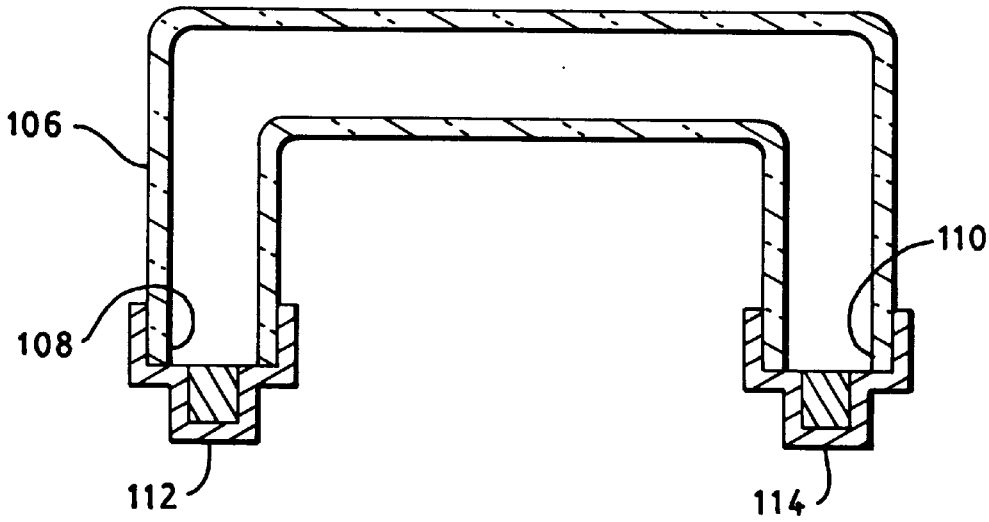
FIG. 11 shows a cross sectional view of an alternatively preferred embodiment of a discharge lamp using a sealing electrode.

FIG. 11 shows a cross sectional view of a tubular lamp envelope with a preformed through passage. The lamp envelope 106 is formed as an extended tube with open tube ends 108, 110. Each tube end 108, 110 is closed by seal electrode, but the rim edge is not pressed into the lamp glass. Rather, the lamp tube end is sealed to the interior wall of the sealing electrode. The sealing electrode then acts as a cap for the lamp end, while at the same time holds the emitter. The interior wall of the seal electrodes 112, 114 are mated to the exterior side walls of the lamp envelope 106 adjacent the tube ends 108, 110. The seal electrodes then act as end caps for the lamp envelope 106. The electrode seals may be coated with a bonding material, such as a pre-coating of glass (pre-glassed), to bond the seal electrodes 112, 114 to the glass of the envelope 106. In a similar fashion the seal electrodes may be sealed to the interior walls of the respective lamp tube ends (corked).

Figure 12:
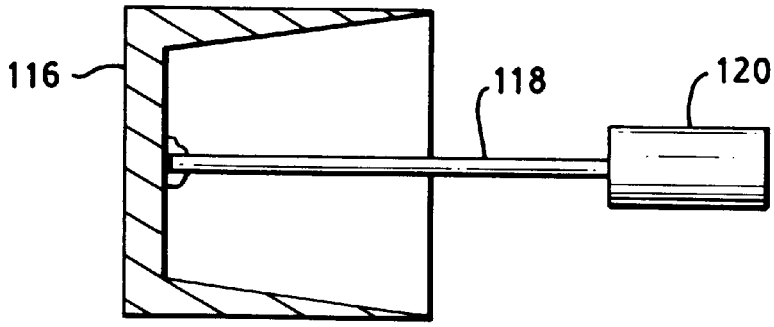
FIG. 12 shows a cross sectional view of an alternative cup and emitter.

FIG. 12 shows a cross sectional view of an alternative cup and emitter. The emitter or internal end of the electrode has been conveniently held directly adjacent the cup. In an alternative shown in FIG. 12, the cup 116 may support a rod 118 or similar extended support to project the emitter 120 or similar internal electrode end into the enclosed volume of the discharge lamp. Convenient couplings to each end the rod 118 may be selected. For example, the cup 116 and rod 118 may be welded together at one end, while the rod 118 and the emitter 120 may be welded or crimped together. This alternative design is particularly useful when there is a preformed passage in the lamp envelope through which the emitter 120 may be extended, and which the cup 116 subsequently seals.

During the opening process the laser erodes a passage through the cover 18 plate to reveal the enclosed pellet 14. The emitter pellet 14 is exposed to the enclosed cavity of the light transmissive envelope. In the preferred embodiment the light transmissive envelope defines an enclosed cavity with two exit passages. It is understood that the method may also be used to form a barrier discharge lamp with one interior electrode and one exterior electrode, and that the present sealing electrode 10 may be adapted to for use in such barrier discharge lamps.

The electrode material, condition and geometry are important to overall lamp performance. The housekeeper seal allows the seal to be preprocessed and environmentally sealed prior to attachment to the glass substraight of the lamp. The glass substraight is heated around a passage formed in the glass until a semi-molten state is achieved. The sealing edge of the cup is them pressed into the hot, pliable glass.

The cup and emitter pellet are pre-processed unit. A pre made emitter (or emitter and getter) pellet is located in the cavity in the cup. The pellet could be encased in it's own jacket. The jacketed pellet may be pressed into a cavity formed within the cup. Alternatively, a pellet could be locked into the cup with a glass or metal covering membrane. Either way, a laser may be focused through an optical window to open the glass or open the jacket containing and protecting the pellet. By not exposing the pellet prior to the usual finishing steps of the lamp making process, the emitter is kept from becoming contaminated. This technique would be equally suited for tubular as well as contoured surface lamps An opening in the glass leading to the cup could be opened by a laser. If that is the case, it is easier to have a prepared cup pre-loaded into the mold in which the glass substraight is formed, than it is having to add a second glass processing step to attach a cup to a subsequently formed hole in the glass. After the cup is opened to the lamp cavity, the lamp processing can take place. The final exposure to the pellet takes place at the optimal lamp processing step The preferred method of assembly is to pre-form pellet 14 from a getter emitter material. The getter emitter is pressed into a sufficiently hard body that it does not disintegrate during assembly or subsequent lamp operation. If the pellet 14 is jacketed, it is inserted in the casing, and sealed in place after any surrounding water vapor, air or other offensive gas or vapor is driven off. An jacketed pellet 14 may be wedged or inserted and then crimped into position in the cavity. An unjacketed pellet 14, cup and lid may be processed in a dry box environment where offensive gases or vapors are excluded, or where only acceptable gases or vapors, such as those expected in the lamp file are present. The processing includes cleaning, and vacuum degassing the can and the pellet 14, before joining the two. The jacketed pellet 14 may be coated with a braising material or a frit where a braising material of frit is used to coat the jacketed pellet 14, these may be melted to form a sealed attachment with the inside of the cup. The unjacketed pellet 14 is then positioned in the cup. The lid is positioned over the pellet 14, and sealed to the cup. The preformed cup and pellet 14 are now ready to be stored, and then attached to the lamp.

The lamp may be constructed in a usual fashion of heating the envelope around a preformed hole so that the adjacent glass becomes pliable. The cup is pressed along it's sealing edge 22 into the pliable glass to form a sealed union of the cup and the lamp envelope 40. The second electrode is similarly positioned in the envelope. The lamp is then pumped clean and filled through a tubulation or by processing in an isolation head. The fill material 50 is then added through the tubulation, and the tubulation is then sealed or through the isolation head. The isolation head can contain the means to complete the seal. The jacketing of the pellet 14 or the cover 18 is then opened, for example by directing a laser through the envelope wall and onto the cover 18 of the jacketing. The cover 18 or jacketing is then melted, or burst by the laser heat, thereby exposing the pellet 14. The small amount of melted jacketing, or cover 18 is not thought to significantly effect the operation of the lamp.

The preferred method of constructing the lamp is to heat the region of the lamp envelope 40 where the sealed electrode is to be positioned.: No pre-exiting passage is formed in the glass envelope. The cup is pressed into the pliable glass and sealed to the envelope wall. Again there is no hole through the envelope wall leading to the cup at this time. The second electrode seal is similarly attached. The lamp envelope is then flushed, filled and sealed. A laser is then focused on the envelope wall to be centered over the cup. The glass material of the envelope is then eroded by the laser heat, and once a passage through the envelope wall is formed and the lamp is partially processed so the jacketing or cover 18 is eroded to expose the pellet 14. This effectively creates a hollow cathode at the cathode end. In this process, the emitter or emitter getter material is exposed only after the lamp is sealed. Again the small amount of glass and metal eroded by the laser is not felt to negatively effect the lamp operation or life. There are several advantages to the second method of construction. First, after sealing the cups to the lamp wall, the lamp may be stored, or lead through other operations before the final cleaning. There is no threat that exposed getter emitter might be contaminated. Second, the lamp cleaning a flushing operation may use gases or materials that might otherwise be inappropriate in the presence of an exposed getter emitter. For example hot oxygen may be used to burn off any carbon base materials. The flush, fill and sealing may be done on a continuous flow, and is not limited to a one entrance (time consuming ) tubulation. Opening of the envelope passages and jacket 16 pellet 14 may also be done in a controlled environment, such as a cold bath so as to control seal stress or condensation of the sputtered material. The preprocessing of the housekeeper electrode eliminates process contamination that currently plagues all in line electrode sealed lamps today.

In a suggested example, some of the dimensions for the sealing electrode may be approximately as follows: The electrically conductive cup may be made of stamped metal sheet 0.25 millimeters thick, and have a circumferential wall with a feathered sealing edge defining an interior volume, and a bottom wall. The first inside diameter may be 10 millimeters, and the second inside diameter may be 5 millimeters. The emitter pellet may be made of rigid emitter or getter emitter such as BCT, and have an outside diameter close to 5 millimeters, and an axial length of 4 millimeters, so that the formed emitter pellet may be pressed into a tight fit with the second inside diameter region of the cup. The light transmissive envelope may be made of glass, hard glass or quartz, and have a wall approximately 1.0 millimeter thick, and an enclosed volume defining a tubular discharge path with a transverse inside diameter typically less than 10 millimeters. A jacket or cover may be made of laser meltable material such as glass or metal, and have a thickness of 0.25 to 0.5 millimeters. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of forming a discharged lamp comprising the steps of:

a) forming an electrically conductive cap having a circumferential sealing edge;

b) forming an emitter pellet;

c) locating and electrically connecting the emitter pellet within the conductive cup;

d) forming a light transmissive envelope;

e) hermetically embedding the sealing edge of the cup into the envelope wall and providing a discharge path from the emitter through the envelope wall; and f) filling and sealing the envelope.

2. A method of forming a discharge lamp comprising the steps of:

a) forming an electrically conductive cup having a circumferential sealing wall, b) forming an emitter pellet, c) supporting and electrically connecting the emitter pellet in the conductive cup, d) forming a light transmissive envelope, e) sealing the cup along the sealing edge to the envelope, to encompass a region of the envelope wall;

f) filling and sealing the envelope with a lamp fill material; and g) after sealing the envelope, opening a passage from the enclosed volume through the envelope wall encompassed by the sealing edge providing a discharge path from the electrode to the enclosed volume.

3. The method in claim 2, wherein sufficient light is focused on the envelope wall to a erode a passage through the envelope wall.

4. A method of forming a discharge lamp comprising the steps of:

a) forming an electrically conductive cup having a circumferential sealing wall, b) forming an emitter pellet, c) supporting and electrically connecting the emitter pellet in the conductive cup, d) providing a meltable hermetic barrier around at least a portion of the emitter pellet;

e) forming a light transmissive envelope, f) sealing the cup along the sealing edge to the envelope, to encompass a region of the envelope wall;

g) filling and sealing the envelope with a lamp fill material; and h) after sealing the envelope, opening a passage from the enclosed volume through the meltable barrier to the emitter pellet providing a discharge path from the electrode to the enclosed volume.

5. The method in claim 4, wherein sufficient energy is focused through a passage in the envelope wall to the barrier to a erode the barrier, and thereby provide a discharge path between the emitter pellet and the enclosed volume.

* * * * *